US008013710B2

(12) United States Patent
Lai et al.

(10) Patent No.: US 8,013,710 B2
(45) Date of Patent: Sep. 6, 2011

(54) MAGNETIC ELEMENT MODULE

(75) Inventors: Yu-Chun Lai, Taoyuan Hsien (TW); Po-Yu Wei, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 12/845,394

(22) Filed: Jul. 28, 2010

(65) Prior Publication Data

US 2011/0025445 A1 Feb. 3, 2011

(30) Foreign Application Priority Data

Jul. 31, 2009 (TW) ..... 98125993 A

(51) Int. Cl.
*H01F 27/24* (2006.01)
*H01F 27/28* (2006.01)

(52) U.S. Cl. ..... 336/212; 336/180; 336/184

(58) Field of Classification Search ..... 336/212, 336/180, 184, 182
See application file for complete search history.

(56) References Cited

U.S. PATENT DOCUMENTS 4,146,859 A * 3/1979 Quirke ..... 336/110
4,471,271 A * 9/1984 Wendt ..... 315/411
5,414,401 A * 5/1995 Roshen et al. ..... 336/178
7,598,839 B1 * 10/2009 Wedley ..... 336/212

* cited by examiner

*Primary Examiner* — Anh Mai
(74) *Attorney, Agent, or Firm* — Kirton & McConkie; Evan R. Witt

(57) ABSTRACT

A magnetic element module includes a magnetic core assembly and at least one first winding structure. The magnetic core assembly includes a first magnetic core and a second magnetic core. The first magnetic core includes a first magnetic slab and a first magnetic post. The second magnetic core includes a second magnetic slab and a second magnetic post. The first winding structure is sheathed around the first magnetic post. The first magnetic post is placed on a second edge of the second magnetic slab. The second magnetic post is placed on a first edge of the first magnetic slab. The first magnetic core, the second magnetic core and the first winding structure are combined together, thereby producing the magnetic element module.

14 Claims, 7 Drawing Sheets

MAGNETIC ELEMENT MODULE

FIELD OF THE INVENTION

The present invention relates to a magnetic element module, and more particularly to a magnetic element module having an L-shaped magnetic core assembly.

BACKGROUND OF THE INVENTION

Nowadays, magnetic elements such as inductors and transformers are widely used in power supply apparatuses or many electronic devices to generate induced magnetic fluxes. Nowadays, the electronic device is developed toward to have small size. As such, the magnetic element and the conductive winding assembly of the magnetic element need to have slim appearance.

Take an inductor for example. FIG. 1 is a schematic exploded view illustrating a conventional inductor. As shown in FIG. 1, the conventional inductor 1 comprises a bobbin 11, a magnetic core assembly 12 and a coil 13. The bobbin 11 has a winding section 111. The coil 13 is wound around the winding section 111. The bobbin 11 has a channel 112 running through the bobbin. Several pins 113 are disposed on the bottom surface of the bobbin 11. The terminals of the coil 13 are connected to the pins 113. Via pins 113, the coil 13 is electrically connected with a circuit board (not shown). As shown in FIG. 1, the magnetic core assembly 12 is an EE-type magnetic core assembly. The magnetic core assembly 12 comprises a first magnetic core 121 and a second magnetic core 122. The first magnetic core 121 comprises a middle post 121*a* and two lateral posts 121*b*. The second magnetic core 122 comprises a middle post 122*a* and two lateral posts 122*b*. For assembling the inductor 1, the middle post 121*a* of the first magnetic core 121 and the middle post 122*a* of the second magnetic core 122 are embedded into the channel 112 of the bobbin 11, and the lateral posts 121*b* of the first magnetic core 121 are aligned with respective lateral posts 122*b* of the second magnetic core 122. Afterward, the inductor 1 is assembled. Due to the electromagnetic induction between the coil 13, the first magnetic core 121 and the second magnetic core 122, an induction voltage is generated by the coil 13.

Since the bottom surfaces of the lateral posts 121*b* of the first magnetic core 121 are contacted with the bottom surfaces of respective lateral posts 122*b* of the second magnetic core 122, misalignment between the first magnetic core 121 and the second magnetic core 122 is readily generated. In this circumstance, magnetic loss is increased, and thus the efficiency of the inductor is reduced. Moreover, since the middle post 121*a* of the first magnetic core 121 and the middle post 122*a* of the second magnetic core 122 are apart from each other by an air gap, an edge effect is generated. As the air gap between the first magnetic core 121 and the second magnetic core 122 is increased, the eddy loss is increased, the edge effect becomes more obvious, and the temperature of the inductor 1 is increased. Since the magnetic core assembly 12 is an EE-type magnetic core assembly and the coil 13 is enclosed by the lateral posts 121*b* and 122*b*, the heat generated by the inductor 1 is difficult to be dissipated away. In this circumstance, the temperature of the inductor 1 is increased and a safety problem occurs. For solving this problem, an additional heat-dissipating mechanism is necessary and the fabricating cost is increased.

Moreover, since the magnetic core assembly 12 is an EE-type magnetic core assembly, the winding window of the inductor 1 is restricted by the EE-type magnetic core assembly. In a case that the winding window of the magnetic element is beyond an acceptable range, the size of the magnetic core assembly 12 and the diameter, turn number or thickness of the coil 13 should be adjusted. As known, the process of changing the specification of the magnetic element is time-consuming and labor-intensive. In addition, the increase of the layout space of the magnetic element increases overall fabricating cost.

Moreover, for installing two inductors 1, the layout space and the material cost should be both doubled. In this circumstance, the layout space and the fabricating cost are increased.

Therefore, there is a need of providing an improved magnetic element module to obviate the drawbacks encountered from the prior art.

SUMMARY OF THE INVENTION

It is an object of the present invention to provide a magnetic element module for eliminating the misalignment problem in order to minimize the eddy loss, the edge effect and the temperature.

Another object of the present invention provides a magnetic element module for reducing overall volume and fabricating cost.

In accordance with an aspect of the present invention, there is provided a magnetic element module. The magnetic element module includes a magnetic core assembly and at least one first winding structure. The magnetic core assembly includes a first magnetic core and a second magnetic core. The first magnetic core includes a first magnetic slab and a first magnetic post. The second magnetic core includes a second magnetic slab and a second magnetic post. The first winding structure is sheathed around the first magnetic post. The first magnetic post is placed on a second edge of the second magnetic slab. The second magnetic post is placed on a first edge of the first magnetic slab. The first magnetic core, the second magnetic core and the first winding structure are combined together, thereby producing the magnetic element module.

In accordance with an aspect of the present invention, there is provided a magnetic element module. The magnetic element module includes a magnetic core assembly, a first winding structure and a second winding structure. The magnetic core assembly includes a first magnetic core and a second magnetic core. The first magnetic core includes a first magnetic slab and a first magnetic post. The second magnetic core includes a second magnetic slab and a second magnetic post. The first winding structure is sheathed around the first magnetic post. The second winding structure is sheathed around the second magnetic post. The first magnetic post is placed on a second edge of the second magnetic slab. The second magnetic post is placed on a first edge of the first magnetic slab. The first magnetic core, the second magnetic core, the first winding structure and the second winding structure are combined together to produce the magnetic element module.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
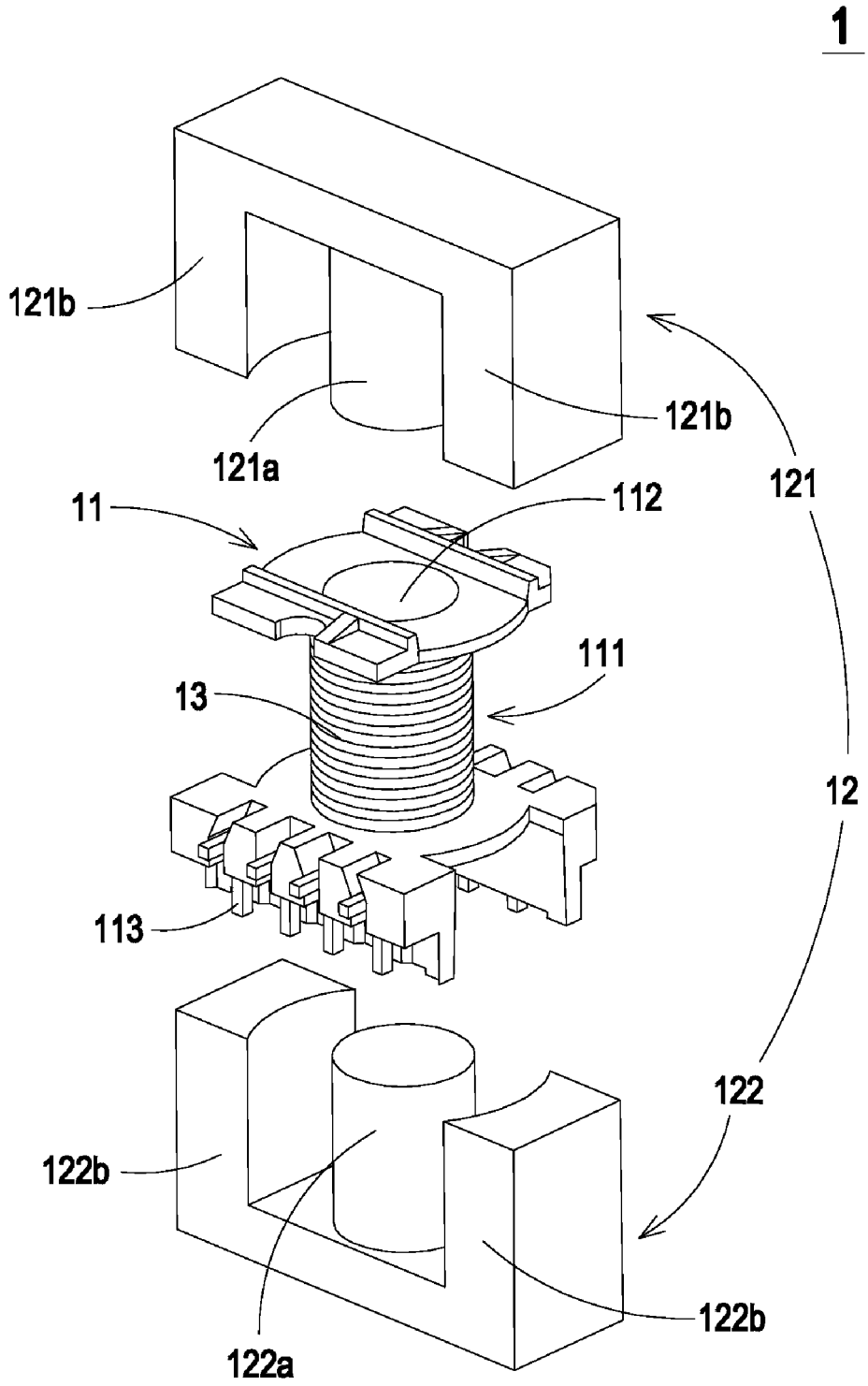
FIG. 1 is a schematic exploded view illustrating a conventional inductor.
Figure 2A:
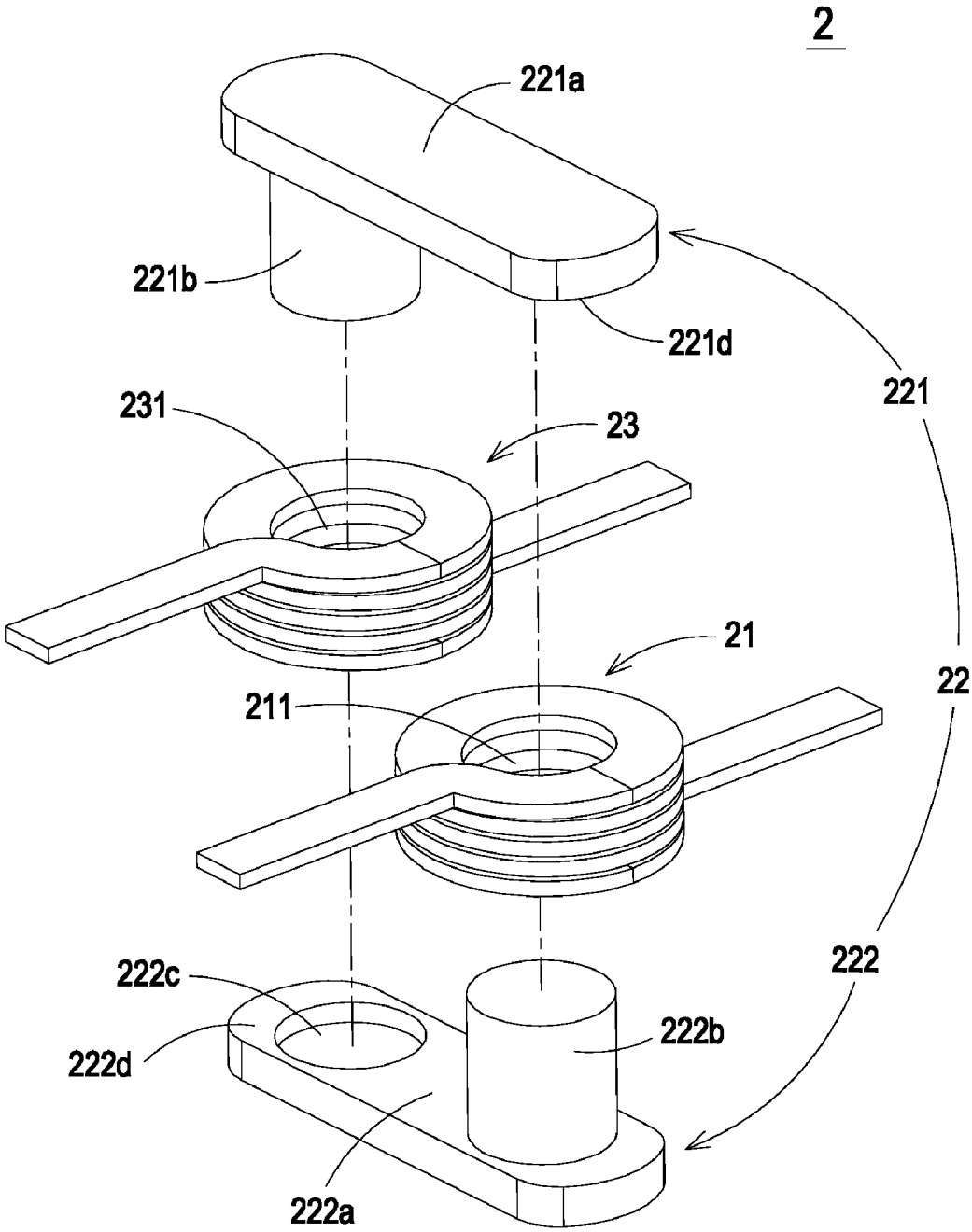
FIG. 2A is a schematic exploded view illustrating a magnetic element according to a first embodiment of the present invention.

FIG. 2A is a schematic exploded view illustrating a magnetic element according to a first embodiment of the present invention. As shown in FIG. 2A, the magnetic element module 2 comprises a first winding structure 23 and a magnetic core assembly 22. The magnetic core assembly 22 comprises a first magnetic core 221 and a second magnetic core 222. The first magnetic core 221 comprises a first magnetic slab 221*a* and a first magnetic post 221*b*. The second magnetic core 222 comprises a second magnetic slab 222*a* and a second magnetic post 222*b*. For assembling the magnetic element module 2, the first winding structure 23 is firstly sheathed around the first magnetic post 221*b*, and then the first magnetic post 221*b* is placed on a second edge 222*d* of the second magnetic slab 222*a* and the second magnetic post 222*b* is placed on a first edge 221*d* of the first magnetic slab 221*a*. After the first magnetic core 221, the second magnetic core 222 and the first winding structure 23 are combined together, the magnetic element module 2 is assembled.

In this embodiment, the first magnetic core 221 and the second magnetic core 222 are L-shaped magnetic cores. In some embodiments, the first magnetic slab 221*a* and the first magnetic post 221*b* of the first magnetic core 221 are integrally formed; and the second magnetic slab 222*a* and the second magnetic post 222*b* of the second magnetic core 222 are integrally formed. In some embodiments, the first magnetic slab 221*a* and the first magnetic post 221*b* are detachably connected with each other; and the second magnetic slab 222*a* and the second magnetic post 222*b* are detachably connected with each other. In some embodiments, a first recess (not shown) is formed in the first edge 221*d* of the first magnetic slab 221*a*; and a second recess 222*c* is formed in the second edge 222*d* of the second magnetic slab 222*a*. The first recess and the second recess 222*c* are aligned with the second magnetic post 222*b* and the first magnetic post 221*b*, respectively.

Figure 2B:
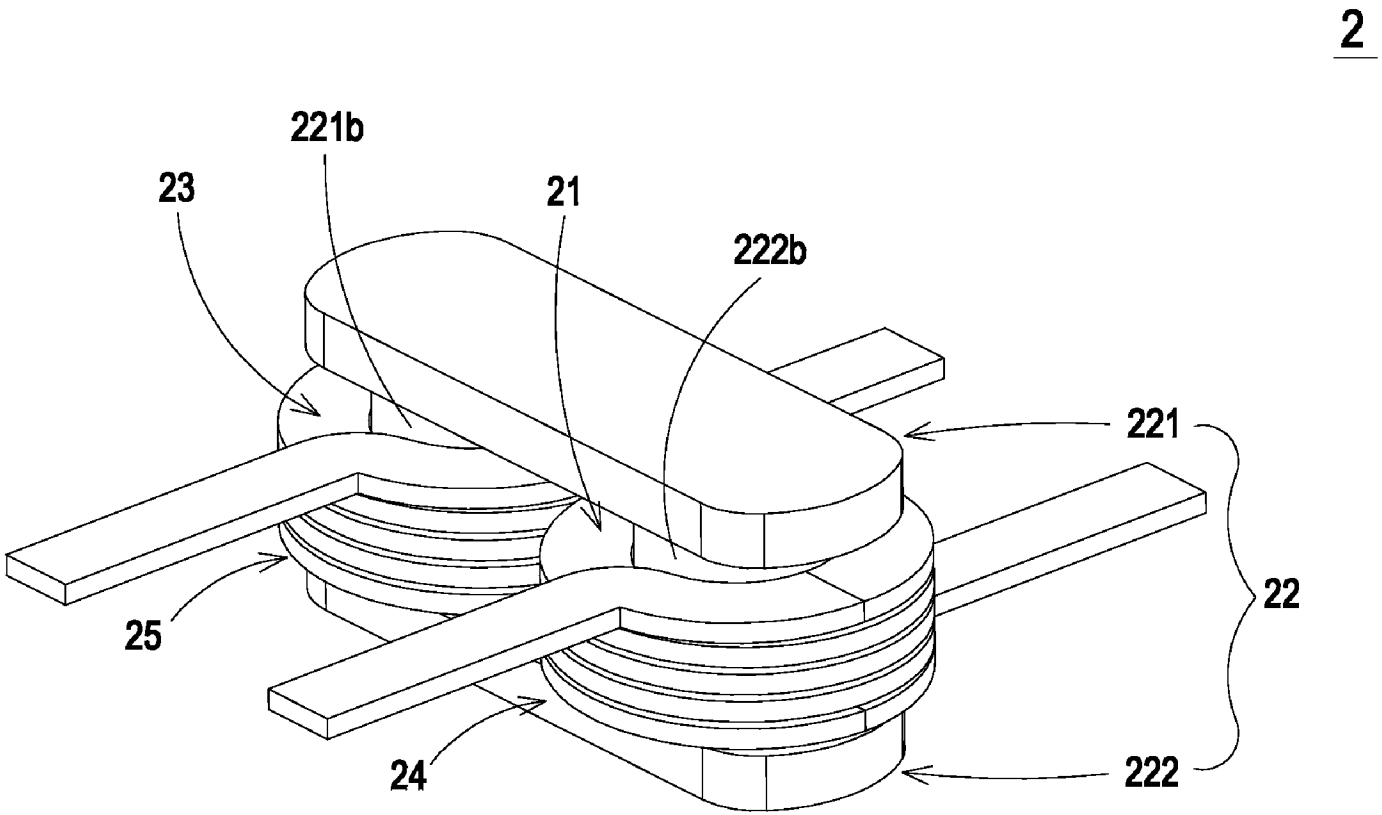
FIG. 2B is a schematic assembled view illustrating the magnetic element as shown in FIG. 2A.

In this embodiment, the magnetic element module 2 further comprises a second winding structure 21. The first winding structure 23 and the second winding structure 21 are both flat winding coils. A process of assembling the magnetic element module 2 will be illustrated as follows. Firstly, the first magnetic post 221*b* of the first magnetic core 221 is penetrated through the channel 231 of the first winding structure 23, and the second magnetic post 222*b* of the second magnetic core 222 is penetrated through the channel 211 of the second winding structure 21, so that the first winding structure 23 and the second winding structure 21 are respectively sheathed around the first magnetic post 221*b* and the second magnetic post 222*b*. Then, the tips of the first magnetic post 221*b* and the second magnetic post 222*b* are respectively accommodated within the second recess 222*c* of the second magnetic slab 222*a* and the first recess of the first magnetic slab 221*a*. After the first magnetic core 221, the second magnetic core 222, the first winding structure 23 and the second winding structure 21 are combined together, the magnetic element module 2 is assembled (see FIG. 2B).

In some embodiments, for facilitating connecting the first magnetic core 221 and the second magnetic core 222, some solder paste may be applied to the junction between the first magnetic post 221*b* and the second recess 222*c* and the junction between the second magnetic post 222*b* and the first recess.

Please refer to FIG. 2B again. The magnetic element module 2 comprises two winding structures. Since the first winding structure 23 and the second winding structure 21 are respectively sheathed around the first magnetic post 221*b* and the second magnetic post 222*b*, electromagnetic induction between the first winding structure 23, the second winding structure 21 and the magnetic core assembly 22 will be generated. In other words, the magnetic element module 2 is composed of two inductors 24 and 25, which are connected in parallel. Since the two inductors 24 and 25 collectively utilize a single magnetic core assembly 22, the overall volume of the magnetic element module 2 is reduced and the fabricating cost is reduced. Moreover, since the first magnetic core 221 and the second magnetic core 222 of the magnetic core assembly 22 have the same profiles, the first magnetic core 221 and the second magnetic core 222 may be produced in the same mold in order to further reduce the fabricating cost.

Figure 3A:
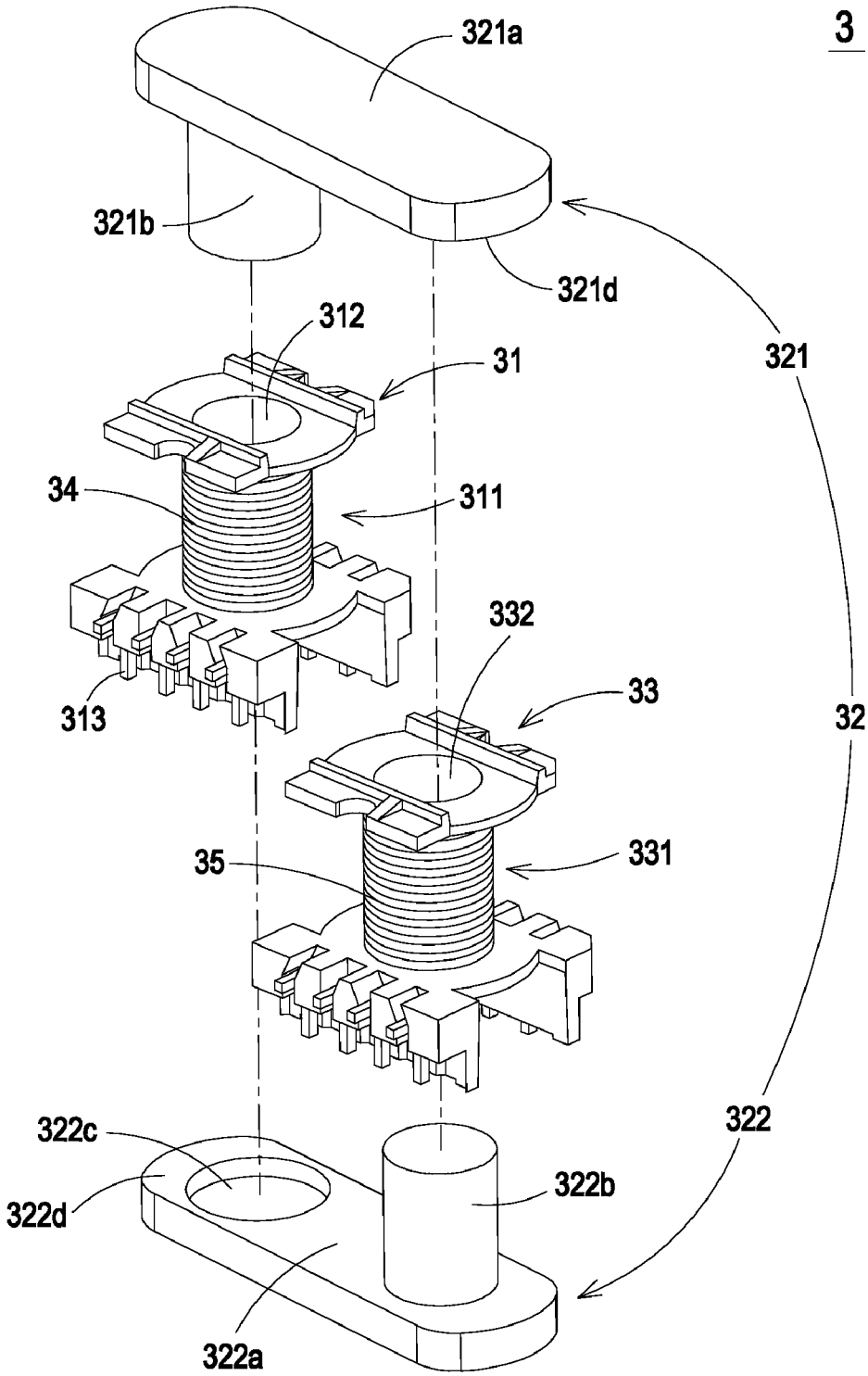
FIG. 3A is a schematic perspective view illustrating a magnetic element according to a second embodiment of the present invention.
Figure 3B:
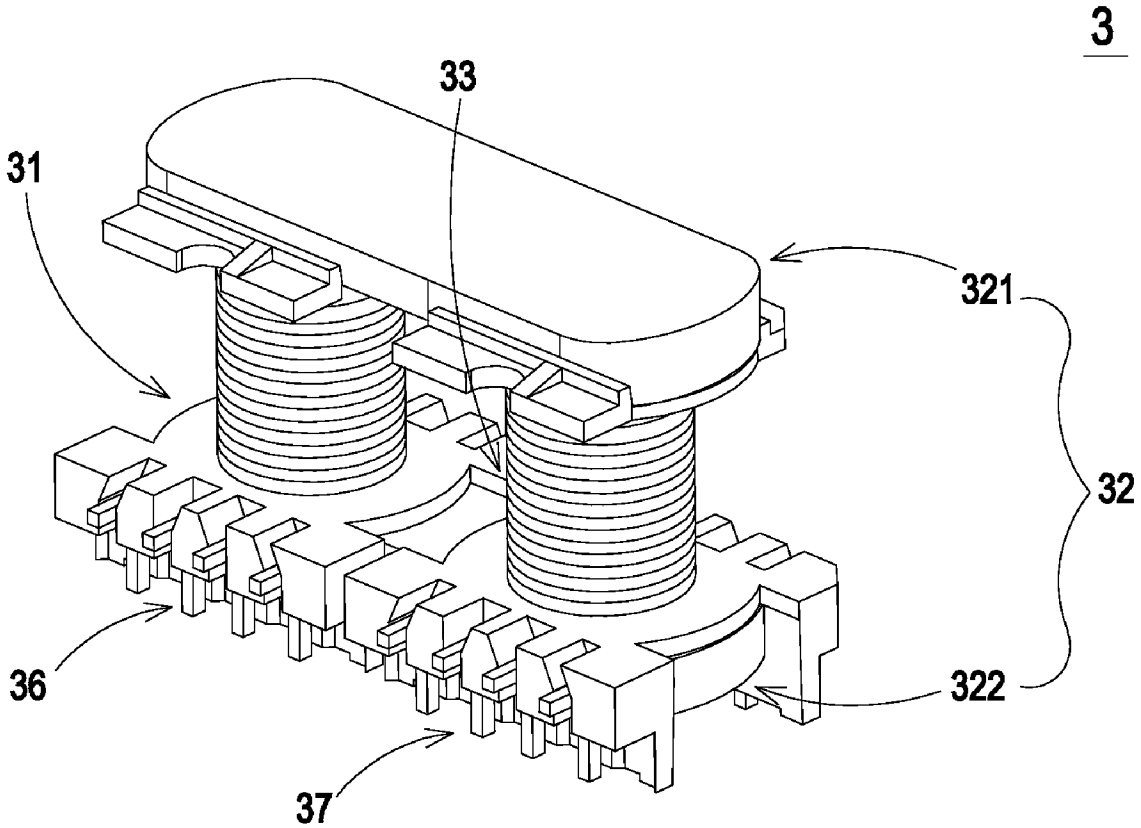
FIG. 3B is a schematic assembled view illustrating the magnetic element as shown in FIG. 3A.

FIG. 3A is a schematic perspective view illustrating a magnetic element according to a second embodiment of the present invention. FIG. 3B is a schematic assembled view illustrating the magnetic element as shown in FIG. 3A. In this embodiment, the magnetic element module 3 comprises a first winding structure 31, a second winding structure 33 and a magnetic core assembly 32. The configurations of the magnetic core assembly 32 are similar to those of the magnetic core assembly 22, and are not redundantly described herein. In this embodiment, the first winding structure 31 and the second winding structure 33 comprise a first bobbin 311 and a second bobbin 331, respectively. The coils 34 and 35 are respectively wound around the first bobbin 311 and a second bobbin 331. In this embodiment, the coils 34 and 35 are flat winding coils, copper slices, or the like.

A process of assembling the magnetic element module 3 will be illustrated as follows. Firstly, the first magnetic post 321*b* of the first magnetic core 321 is penetrated through the channel 312 of the first bobbin 311 of the first winding structure 31, and the second magnetic post 322*b* of the second magnetic core 322 is penetrated through the channel 332 of the second winding structure 33, so that the first winding structure 31 and the second winding structure 33 are respectively sheathed around the first magnetic post 321*b* and the second magnetic post 322*b*. Then, the tips of the first magnetic post 321*b* and the second magnetic post 322*b* are respectively accommodated within the second recess 322*c* of the second magnetic slab 322*a* and the first recess (not shown) of the first magnetic slab 321*a*. After the first magnetic core 321, the second magnetic core 322, the first winding structure 31 and the second winding structure 33 are combined together, the magnetic element module 3 is assembled (see FIG. 3B). As shown in FIG. 3B, the magnetic element module 3 is composed of two transformers 36 and 37, which are connected in parallel. Since the two transformers 36 and 37 collectively utilize a single magnetic core assembly 32, the overall volume of the magnetic element module 3 is reduced and the fabricating cost is reduced.

Figure 4A:
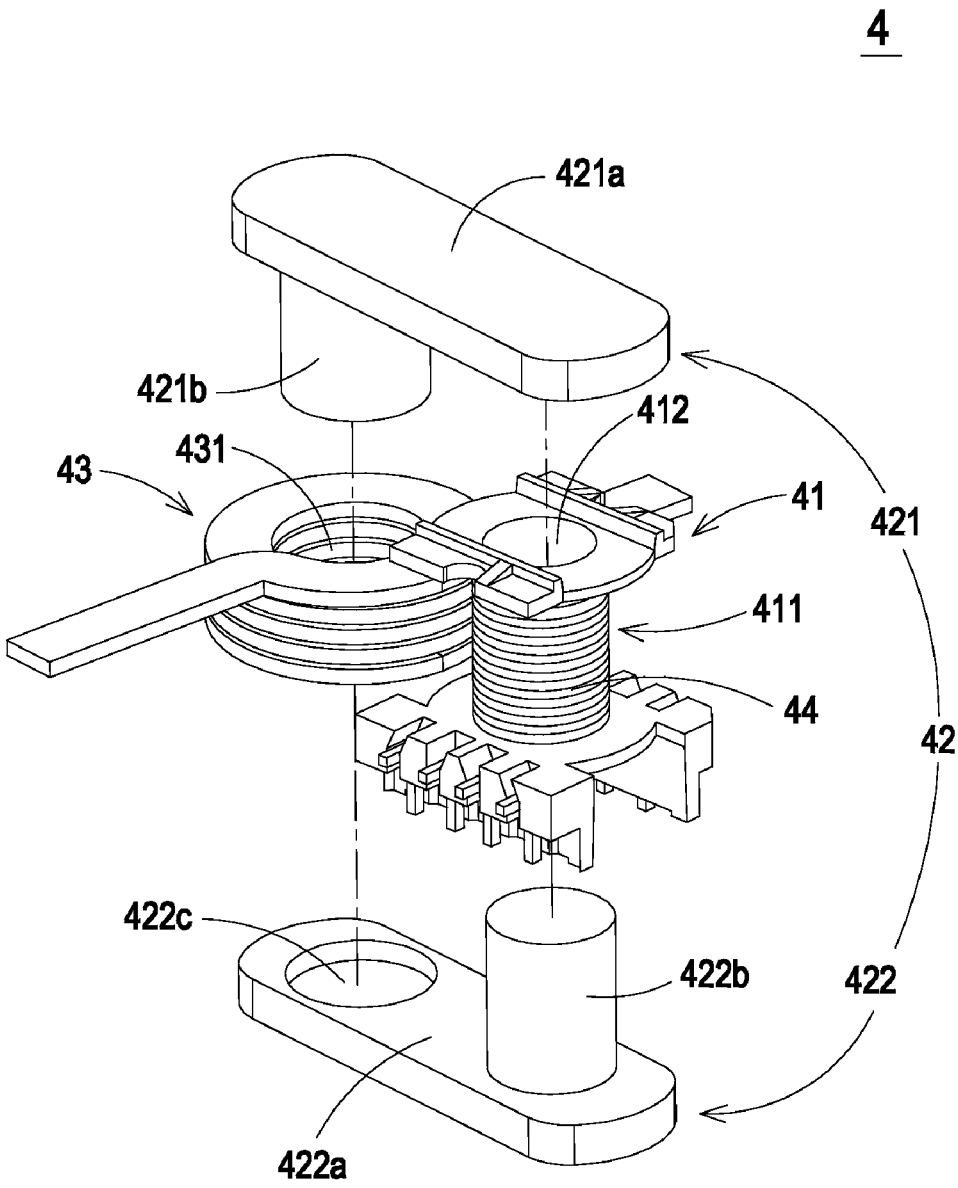
FIG. 4A is a schematic perspective view illustrating a magnetic element according to a third embodiment of the present invention.
Figure 4B:
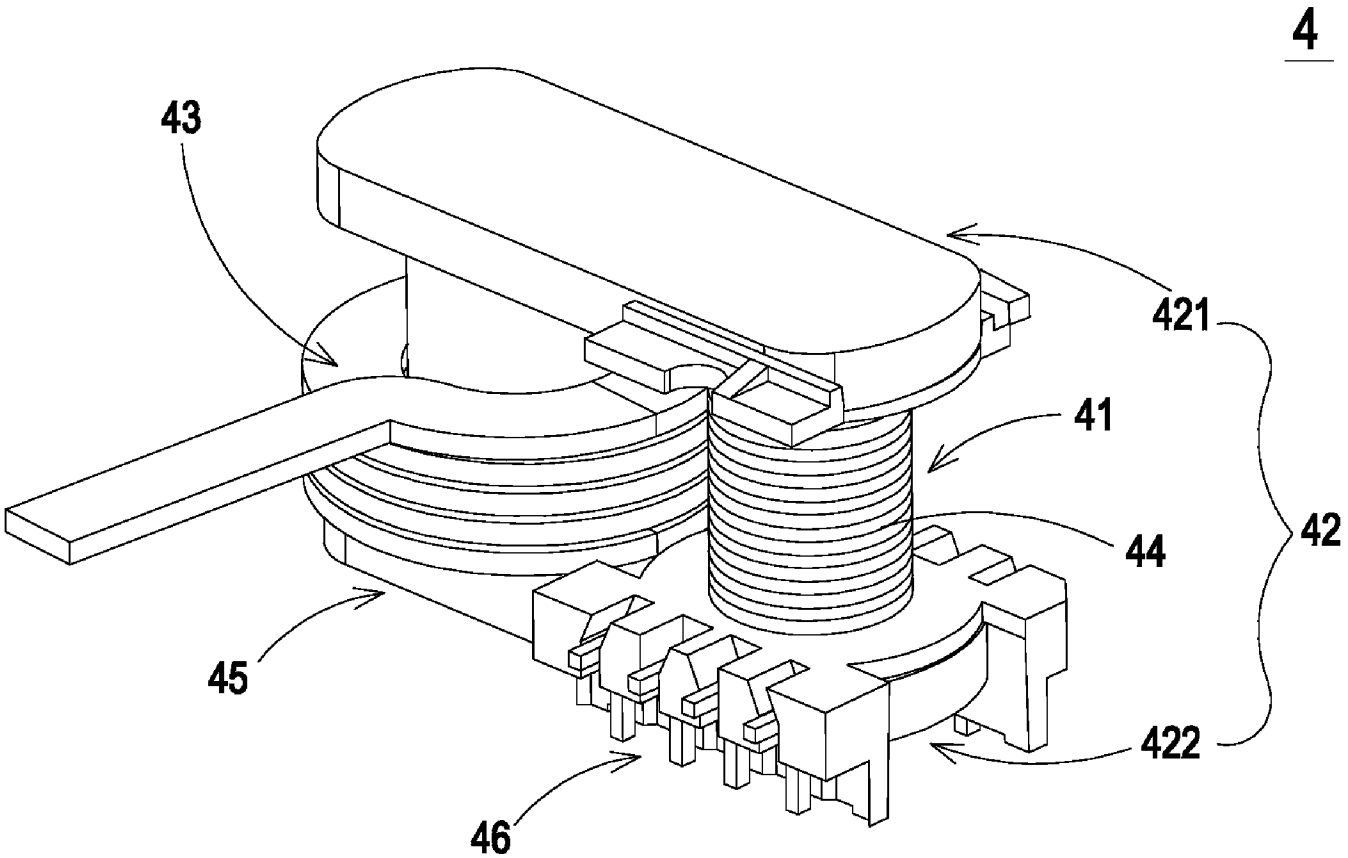
FIG. 4B is a schematic assembled view illustrating the magnetic element as shown in FIG. 4A.

FIG. 4A is a schematic perspective view illustrating a magnetic element according to a third embodiment of the present invention. FIG. 4B is a schematic assembled view illustrating the magnetic element as shown in FIG. 4A. In this embodiment, the magnetic element module 4 comprises a first winding structure 43, a second winding structure 41 and a magnetic core assembly 42. The magnetic core assembly 42 comprises a first magnetic core 421 and a second magnetic core 422. The first magnetic core 421 comprises a first magnetic slab 421*a*, a first magnetic post 421*b* and a first recess (not shown). The second magnetic core 422 comprises a second magnetic slab 422*a*, a second magnetic post 422*b* and a second recess 422*c*. Similarly, the first magnetic core 421 and the second magnetic core 422 of the magnetic core assembly 42 are L-shaped magnetic cores. The configurations of the magnetic core assembly 42 are similar to those of the magnetic core assembly 22 or 32, and are not redundantly described herein. The second winding structure 41 further comprises a second bobbin 411, and a coil 44 is wound around the second bobbin 411. That is, the second winding structure 41 is a winding coil assembly. In addition, the first winding structure 43 is a flat winding coil.

A process of assembling the magnetic element module 4 will be illustrated as follows. Firstly, the first magnetic post 421*b* of the first magnetic core 421 is penetrated through the channel 431 of the first winding structure 43, and the second magnetic post 422*b* of the second magnetic core 422 is penetrated through the channel 412 of the second winding structure 41, so that the first winding structure 43 and the second winding structure 41 are respectively sheathed around the first magnetic post 421*b* and the second magnetic post 422*b*. Then, the tips of the first magnetic post 421*b* and the second magnetic post 422*b* are respectively accommodated within the second recess 422*c* of the second magnetic slab 422*a* and the first recess (not shown) of the first magnetic slab 421*a*. After the first magnetic core 421, the second magnetic core 422, the first winding structure 43 and the second winding structure 41 are combined together, the magnetic element module 4 is assembled (see FIG. 4B). As shown in FIG. 4B, the magnetic element module 4 is composed of an inductor 45 and a transformer 46. Since the inductor 45 and the transformer 46 collectively utilize a single magnetic core assembly 42, the overall volume of the magnetic element module 4 is reduced.

In the above embodiments, the magnetic element module may be a combination of two inductors, a combination of two inductors, or a combination of an inductor and a transformer. As a consequence, the flexibility and diversity of the magnetic element module are enhanced.

As previously described, the applications of the EE-type magnetic core assembly are restricted by the lateral posts. Whereas, according to the present invention, the positions of the first magnetic post 421*b* and the second magnetic post 422*b* of the magnetic core assembly 42 may be fine-tuned in order to comply with the practical requirements. Since the junction between the first magnetic post 421*b* and the second recess 422*c* is located in the second magnetic slab 422*a* and the junction between the second magnetic post 422*b* and the first recess is in the first magnetic slab 421*a*, the eddy loss is reduced. Moreover, since the first winding structure 43 and the second winding structure 41 are no longer enclosed by the magnetic core assembly 42, the heat generated by the magnetic element module 4 could be effectively radiated to the air. As a consequence, the heat-dissipating efficacy is enhanced and the temperature is reduced.

From the above description, the magnetic element module of the present invention includes a first winding structure, a second winding structure and an L-shaped magnetic core assembly. The magnetic core assembly comprises a first magnetic core and a second magnetic core. The first magnetic core comprises a first magnetic slab and a first magnetic post. The second magnetic core comprises a second magnetic slab and a second magnetic post. The first magnetic post and the second magnetic post are respectively penetrated through the channels of the first winding structure and the second winding structure. After the first magnetic core, the second magnetic core, the first winding structure and the second winding structure are combined together, the magnetic element module is assembled. In other words, the magnetic element module of the present invention is composed of two magnetic elements, which are connected in parallel. Since the two magnetic elements collectively utilize a single magnetic core assembly, the flexibility and diversity of the magnetic element module are enhanced, the overall volume of the magnetic element module is reduced and the fabricating cost is reduced. Moreover, since the junctions between the first magnetic core and the second magnetic core are located in the first magnetic slab and the second magnetic slab, the eddy loss and the temperature are reduced. Since the two magnetic elements collectively utilize a single magnetic core assembly, the fabricating process is simplified, the misalignment problem is minimized, and the overall volume is reduced.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A magnetic element module, comprising:

a magnetic core assembly comprising a first magnetic core and a second magnetic core, wherein said first magnetic core comprises a first magnetic slab and a first magnetic post, and said second magnetic core comprises a second magnetic slab and a second magnetic post;

a first winding structure; and a second winding structure;

wherein said first winding structure and said second winding structure are sheathed around said first magnetic post and said second magnetic post, respectively, said first magnetic post is placed on a second edge of said second magnetic slab, said second magnetic post is placed on a first edge of said first magnetic slab, and said first magnetic core, said second magnetic core and said first winding structure are combined together to produce said magnetic element module.

2. The magnetic element module according to claim 1 wherein said first magnetic post is integrally formed with said first magnetic slab.

3. The magnetic element module according to claim 1 wherein said first magnetic slab and said first magnetic post are detachably connected with each other.

4. The magnetic element module according to claim 1 wherein said second magnetic post is integrally formed with said second magnetic slab.

5. The magnetic element module according to claim 1 wherein said second magnetic slab and said second magnetic post are detachably connected with each other.

6. The magnetic element module according to claim 1 wherein a first recess is formed in said first edge of said first magnetic slab and aligned with said second magnetic post, so that said second magnetic post is accommodated within said first recess.

7. The magnetic element module according to claim 1 wherein a second recess is formed in said second edge of said second magnetic slab and aligned with said first magnetic post, so that said first magnetic post is accommodated within said second recess.

8. The magnetic element module according to claim 1 wherein said first winding structure is a winding coil, a flat winding coil or a copper slice.

9. The magnetic element module according to claim 8 wherein said first winding structure includes a first bobbin, and said winding coil, said flat winding coil or said copper slice is wound around said first bobbin.

10. The magnetic element module according to claim 1 wherein said second winding structure is a winding coil, a flat winding coil or a copper slice.

11. The magnetic element module according to claim 10 wherein said second winding structure includes a second bobbin, and said winding coil, said flat winding coil or said copper slice is wound around said second bobbin.

12. The magnetic element module according to claim 1 wherein said magnetic element module is a combination of two inductors.

13. The magnetic element module according to claim 1 wherein said magnetic element module is a combination of two transformers.

14. The magnetic element module according to claim 1 wherein said magnetic element module is a combination of an inductor and a transformer.

* * * * *